United States Patent [19]

Rautenberg

[11] Patent Number: 4,610,654

[45] Date of Patent: Sep. 9, 1986

[54] GUIDE STRUCTURE FOR APPARATUS FOR SACK END FORMING APPARATUS

[75] Inventor: Horst Rautenberg, Lienen, Fed. Rep. of Germany

[73] Assignee: Windmoller & Holscher, Lengerich, Fed. Rep. of Germany

[21] Appl. No.: 700,130

[22] Filed: Feb. 11, 1985

[30] Foreign Application Priority Data

Feb. 13, 1984 [DE] Fed. Rep. of Germany ..... 3405066

[51] Int. Cl.[4] ..... B31B 1/00

[52] U.S. Cl. ..... 493/477; 226/197; 226/198; 226/199

[58] Field of Search ..... 493/248, 436, 438, 447, 493/455, 476, 477; 198/836; 226/197, 198, 199

[56] References Cited

U.S. PATENT DOCUMENTS

| | | | |
|---|---|---|---|
| 3,174,669 | 3/1965 | Zernov | 226/199 |
| 4,285,686 | 8/1981 | Ambler | 493/476 |
| 4,428,521 | 1/1984 | Rich | 226/199 |

FOREIGN PATENT DOCUMENTS

| | | |
|---|---|---|
| 7412879 | 11/1974 | Fed. Rep. of Germany . |
| 2639265 | 3/1978 | Fed. Rep. of Germany . |
| 2743797 | 4/1979 | Fed. Rep. of Germany . |

*Primary Examiner*—Leon Gilden

*Attorney, Agent, or Firm*—Fleit, Jacobson, Cohn & Price

[57] ABSTRACT

This invention relates to a structure for guiding tubular blanks through a sack end forming station through which the tubular blanks are transversely conveyed on a path of travel, said structure comprising two plates, which are disposed on opposite sides of said path of travel, and guiding surfaces associated with said plates and defining adjacent to said path of travel a gap which has a width that is at least as large as the thickness of the tubular blank. At least one of said guiding surfaces is formed by a bar, which is associated with one of said plates and capable of a limited movement in the plane of said plate and is urged toward the other plate by springs.

5 Claims, 2 Drawing Figures

GUIDE STRUCTURE FOR APPARATUS FOR SACK END FORMING APPARATUS

BACKGROUND OF THE INVENTION

1. Field of the Invention

This invention relates to a structure for guiding tubular blanks through a sack end forming station through which the tubular blanks are transversely conveyed on a path of travel, said structure comprising two plates, which are disposed on opposite sides of said path of travel, and guiding surfaces associated with said plates and defining adjacent to said path of travel a gap which has a width that is at least as large as the thickness of the tubular blank.

2. Description of the Prior Art

In sack end forming apparatus of this kind, which are known, e.g., from Published German Application 26 39 265 and 27 43 797 and from German Utility Model Specification 74 12 879, said guiding surfaces are formed by the confronting edges of said plates, which extend across the transversely conveyed tubular blanks in the length which is required for the formation of the sack ends and define gaps having a width which is equal to the thickness of the thickest tubular blank which is to be processed. In those apparatus the width of the gaps depends on the thickness of the paper used in the tubular blanks and on the number of plies forming the walls of the tubular blank. In the operation of the known apparatus the sack ends which have been formed and passed along the gap where crimped or upset or even torn at their leading edges. The cause of the phenomenon was not known before.

SUMMARY OF THE INVENTION

It is an object of the invention to provide sack end forming apparatus for processing transversely conveyed tubular blanks in such a manner that the sack ends are formed not damaged as they are formed.

In apparatus of the kind described first hereinbefore that object is accomplished in that at least one of said guiding surfaces is formed by a bar, which is associated with one of said plates and capable of a limited movement in the plane of said plate and is urged toward the other plate by springs. The invention is based on the recognition that the damage which has been observed is due to the fact that the leading edges of the sack ends which have been formed tend to be drawn into the gap. In the apparatus in accordance with the invention such drawing of the ends of the tubular blanks into the guiding gap is prevented because owing to the provision of the spring-biased bar the width of that gap is always equal to the thickness of the tubular blank. Under a slight spring bias, the bar bears on each tubular blank so that the width of the gap is adjusted to the instantaneous thickness of the tubular blank. The previously unknown cause of the damage to the leading edges of the sack ends formed on the tubular blanks resided in that the thickness of the tubular blanks differed from the width of the gap. The damage can be surprisingly avoided in a most simple manner in accordance with the invention by the provision of a spring-biased bar by which the guiding gap is defined.

In a preferred arrangement, the plates extend in a vertical plane and the upper plate is provided with the spring-biased bar.

In order to ensure that the tubular blanks will smoothly move into the gap, the entrance portion of that gap suitably flares rearwardly in wedge shape.

Further preferred features of the invention are recited in the dependent claims.

Figure 1:
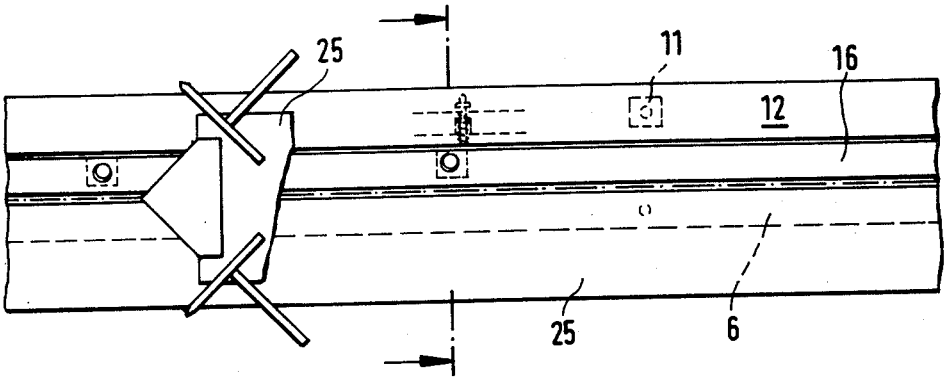
FIG. 1 is a diagrammatic side elevation showing the structure for guiding transversely conveyed tubular blanks through a sack end forming station.

The guide structure comprises edge-forming members, which define a guiding gap. Said edge-forming members are secured to carrying sections 1 and 8, 9, which are connected to a machine frame in a manner which is not shown. The lower carrier 1 is a channel section having an inner leg 2, which is connected to a sheet metal table top 3, which extends in the plane on which the tubular blanks are transversely conveyed. The inner portions of said tubular blanks are supported on the table top 3.

The channel section 1 has also a free leg 4, which is fixed to a plate 5, which extends in the longitudinal direction of the machine. A spacing section 6 is interposed between the leg 4 and the plate 5 throughout the length of the machine. A carrier consisting of two screw-connected channel sections 8, 9 extends above the channel section 1. Spaced apart spacers 11 are screw-connected to the free leg 10 of the upper channel section 9 and carry a stationary plate 12, which has lugs 13 formed with through bores 14. Rods 15 extend through said bores 14 and at their lower ends are secured to a tubular bar 16. Compression springs 17 surround the rods 15 between the lugs 13 and the tubular bar 16. Each tubular bar 16 is formed with spaced apart pairs of aligned through bores 18 and 19. In each pair, one bore 18 is much larger than the other bore 19.

A stepped member 20 which has been machined in a lathe is inserted into each of said pairs of bores 18, 19. The larger diameter of the stepped member 20 is smaller than the bore 18. The smaller diameter of the stepped member 20 is smaller than the bore 19. The free leg 21 of the channel section 8 has a bore 22, through which a screw 23' extends, by which the stepped member 20 is pulled against the free leg 21 of the channel section 8. In order to prevent a clamping of the tubular bar 16 against the free leg 21, the thinner portion of the stepped member 20 has a length which exceeds the thickness of the wall 23 of the tubular bar 16.

Figure 2:
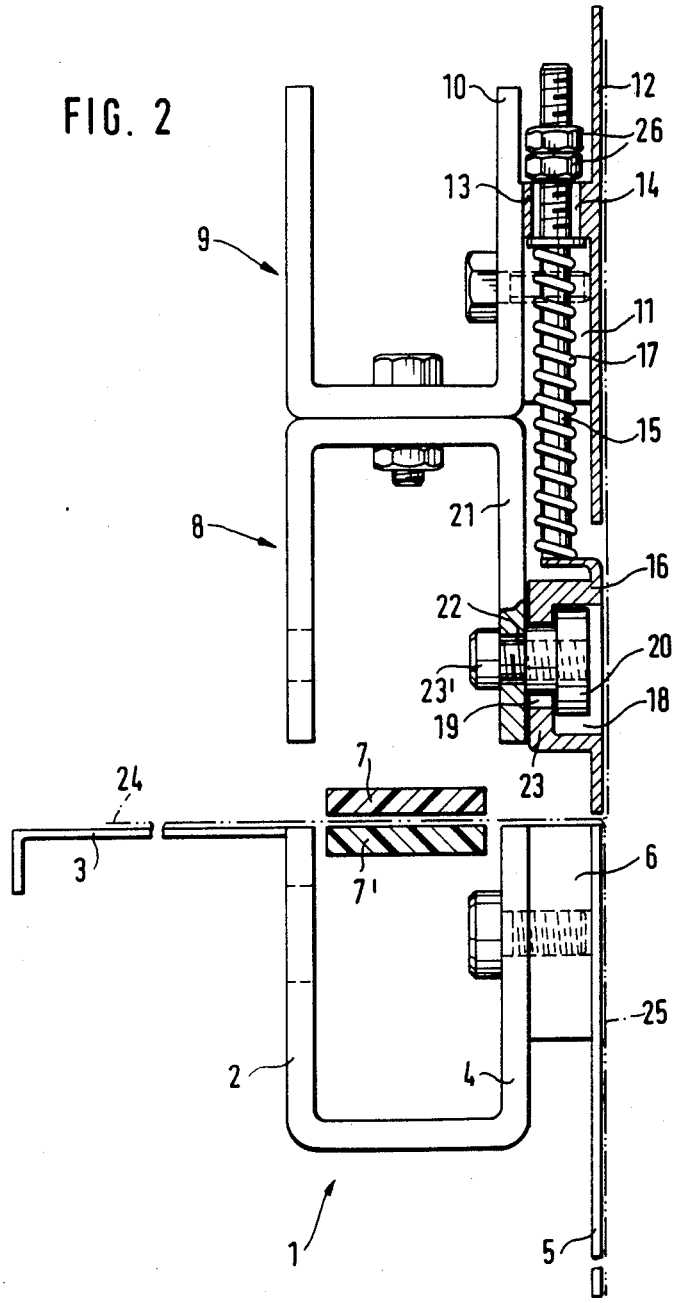
FIG. 2 is a transverse sectional view taken on line II—II in FIG. 1.

The difference between the diameters of the thinner portion of the stepped member 20 and the bore 19 in the wall 23 of the tubular bar 16 determines the extent to which the tubular bar 16 can be adjusted in height. It will be understood that the diameter of the thicker portion of the stepped member 20 must be so selected that that movement will not be obstructed. In the position shown in FIG. 2 the spring 17 has moved the tubular bar 16 to a lower position, which will be assumed during the processing of a sack 24 having an end 25. During the manufacture of a sack having a larger number of plies, that sack will urge the tubular bar 16 upwardly against the force of the spring 17 to such an extent that the sack can smoothly pass below the tubular section but a contact between the tubular bar 16 with the sack will always be ensured.

The sack 24 is conveyed in the plane of the gap defined between the plate 5 and the tubular bar 16 by conveyor belts 7, 7', which grip the sack between them.

In the position shown on the drawing, the wall 23 of the tubular bar 16 engages the thinner portion of the stepped member 20. But the guiding gap should desirably be wider in its entrance portion so that all/sacks can smoothly enter the gap. Behind the entrance portion the width of the gap should progressively decrease. For this purpose, two lock nuts 26 are screwed onto the free end portion of each rod 15 and can be adjusted to slightly raise the tubular bar 16 in the entrance region of the machine so as to increase the width of the gap in that region.

I claim:

1. A structure for guiding tubular blanks through a sack end forming station through which the tubular blanks are transversely conveyed on a path of travel, said structure comprising two plates, which are disposed on opposite sides of said path of travel, and guiding surfaces associated with said plates and defining adjacent to said path of travel a gap which has a width that is at least as large as the thickness of the tubular blank, characterized in that at least one of said guiding surfaces is formed by a bar, which is associated with one of said plates and capable of a limited movement in the plane of said plate and is urged toward the other plate by springs.

2. A structure according to claim 1, characterized in that the plates extend in a vertical plane and the upper plate is provided with the spring-biased bar.

3. A structure accordint to claim 1, characterized in that the entrance portion of the gap between the bar and the other plate flares rearwardly in wedge shape.

4. A structure according to claim 1, characterized in that the bar is secured to bolts, which extend through bores formed in brackets connected to the associated plate or to a carrier for said plate, said bolts are supported at the top of said bores by nuts or the like, and said bolts are surrounded by compression springs, which abut at one end on the brackets and at the other end on the bar.

5. A structure according to claim 1, characterized in that the bar is tubular and is connected to a carrier by means of screws provided with collars or washers so as to provide a small axial play for the bar, and said screws extend through bores of the bar with a clearance which permits a limited lateral movement of the bar.

* * * * *